US008614651B2

(12) United States Patent
Chen et al.

(10) Patent No.: US 8,614,651 B2
(45) Date of Patent: Dec. 24, 2013

(54) THIN APPARATUS FOR DISPLAYING IMAGE

(75) Inventors: Xiong Chen, Beijing (CN); Katsumi Yamatogi, Beijing (CN); Osamu Kihara, Beijing (CN)

(73) Assignee: Sony (China) Limited, Beijing (CN)

( * ) Notice: Subject to any disclaimer, the term of this patent is extended or adjusted under 35 U.S.C. 154(b) by 1586 days.

(21) Appl. No.: 11/941,390

(22) Filed: Nov. 16, 2007

(65) Prior Publication Data

US 2008/0117121 A1 May 22, 2008

(30) Foreign Application Priority Data

Nov. 17, 2006 (CN) ..... 2006 1 0146934

(51) Int. Cl.
*G09G 3/00* (2006.01)

(52) U.S. Cl.
USPC ..... 345/30; 345/905; 361/679.21

(58) Field of Classification Search
USPC ..... 345/30, 905; 361/679.02, 679.21, 361/679.22; 348/794, 836, 843
See application file for complete search history.

(56) References Cited

U.S. PATENT DOCUMENTS 6,188,569 B1 * 2/2001 Minemoto et al.
7,525,602 B2 * 4/2009 Yamamoto

FOREIGN PATENT DOCUMENTS

| | | |
|---|---|---|
| JP | 2004-109396 | 4/2004 |
| JP | 2005-223748 | 8/2005 |
| JP | 2005-318241 | 11/2005 |
| JP | 2006-58587 | 3/2006 |

* cited by examiner

*Primary Examiner* — Regina Liang
(74) *Attorney, Agent, or Firm* — Oblon, Spivak, McClelland, Maier & Neustadt, L.L.P.

(57) ABSTRACT

A thin apparatus for displaying image, comprising: a first input terminal (6*a*) for inputting image signal, the first input terminal (6*a*) is located on back side of the thin apparatus; a panel (2) for displaying images, the panel (2) is located on front side of the thin apparatus; and a control circuit (3) for controlling the image signal, wherein the axis of the first input terminal (6*a*) is substantively parallel to the back of the panel (2), the control circuit (3) is located under the panel (2), and shapes that the width is longer than the height. Compared with the prior art, the thickness and height of the thin apparatus of this invention are greatly reduced, and the whole structure of it becomes more compact and proper because this invention considers the combination of the position and shape of the control circuit (3), and the arrangement of the first input terminal (6*a*) for the first time.

8 Claims, 5 Drawing Sheets

THIN APPARATUS FOR DISPLAYING IMAGE

TECHNICAL FIELD

The present invention relates to an electronic displaying apparatus for displaying image, in particular to a thin apparatus for displaying image.

BACKGROUND ART

The thin apparatuses for displaying image such as plasma TVs and LCDs are in flavor with people increasingly due to their advantages such as small volume, easy operation and like. However, the design of the thin apparatus for displaying image with more compact structure is a very difficult technical project, because the design relates to a plurality of factors such as displaying panel, control circuit, input/output terminals as well as the shapes and layout thereof.

Japanese patent No. JP2006-58587 disclosed a thin apparatus for displaying image in which control circuit is arranged on the back of displaying panel, however, in addition to its poor heat-sinking capability, the most disadvantage of this kind of thin displaying apparatus is that the overall size in thickness direction (the sum of the thickness of displaying panel and the thickness of control circuit) of the displaying apparatus is still large and the structure is incompact, resulting in that it is difficult to hang it on the wall stably.

Japanese patent No. JP2004-109396 disclosed another thin apparatus for displaying image in which control circuit is arranged under displaying panel, however, this patent document did not disclose specifically the shape of control circuit, that is, it did not take the influence of the shape of control circuit upon the overall structure and layout of the displaying apparatus into account.

Japanese patent No. JP2005-318241 disclosed a TV set in which its input terminal has the vertical and downward orientation. Japanese patent No. JP2005-318241 disclosed a displaying apparatus in which its output terminal and input terminal have the leftward and rightward orientations respectively. However, both above patent documents disclosed neither the position and the shape of control circuit nor the arrangement of respective terminals on the control circuit, that is, these two did not take the influence of the position and the shape of control circuit as well as the respective terminals upon the overall structure and layout of the displaying apparatus into account.

In summary, for the designs of the thin apparatuses for displaying image of the prior art, the designers tend to take the influence of a certain factor upon a displaying apparatus rather than a plurality of factors upon the overall structure and layout thereof into account, resulting in the incompact structure and the unreasonable layout of the displaying apparatus of the prior art.

SUMMARY

In view of the above, a main object of the present invention is to provide a thin apparatus for displaying image with more compact structure and more reasonable layout.

In order to achieve the object, there is provided a thin apparatus for displaying image, comprising: a first input terminal for inputting image signal, said first input terminal is located on the back side of the thin apparatus; a displaying panel for displaying image, said displaying panel is located on the front side of the thin apparatus; and a control circuit for processing the image signal, wherein the axis of said first input terminal is substantially parallel to the back of said displaying panel, said control circuit is located under said displaying panel, and the width of said control circuit is longer than its height.

Another object of the present invention is to provide a thin apparatus for displaying image which has the input/output terminals easy to plug and connect.

In order to achieve the object, said first input terminal is located at a certain distance from the bottom of the thin apparatus.

Compared with the prior art, the thickness and height of the displaying apparatus are greatly reduced, and the overall structure thereof becomes more compact and its layout more reasonable because the present invention comprehensively takes the shape (the width is larger than the height) and the position (it is located under the displaying panel) of the control circuit as well as the arrangement of the first input terminal (the axis thereof is substantially parallel to the back of the displaying panel) into account for the first time.

DETAILED DESCRIPTION OF PREFERRED EMBODIMENT

Figure 1:
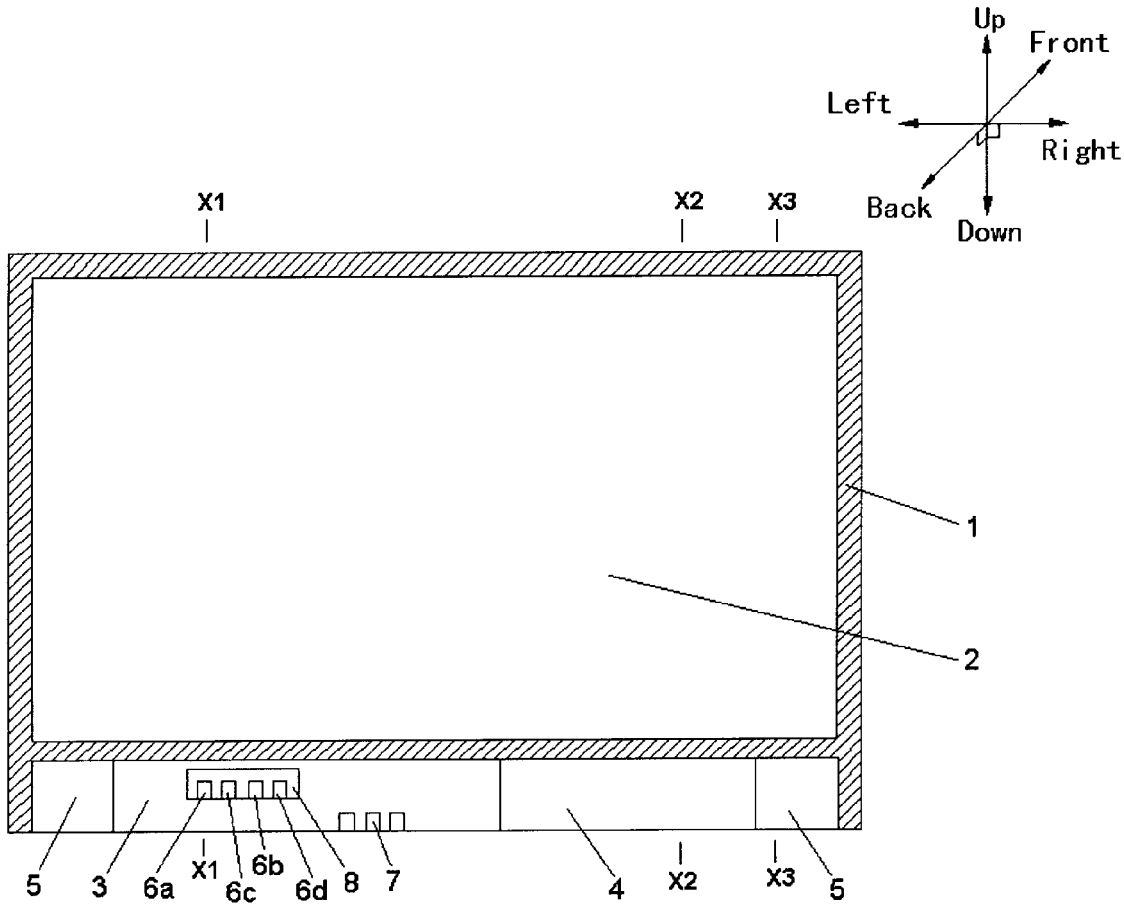
FIG. 1 is a schematic view of the overall structure of the thin apparatus for displaying image of the first embodiment of the present invention.
Figure 2A:
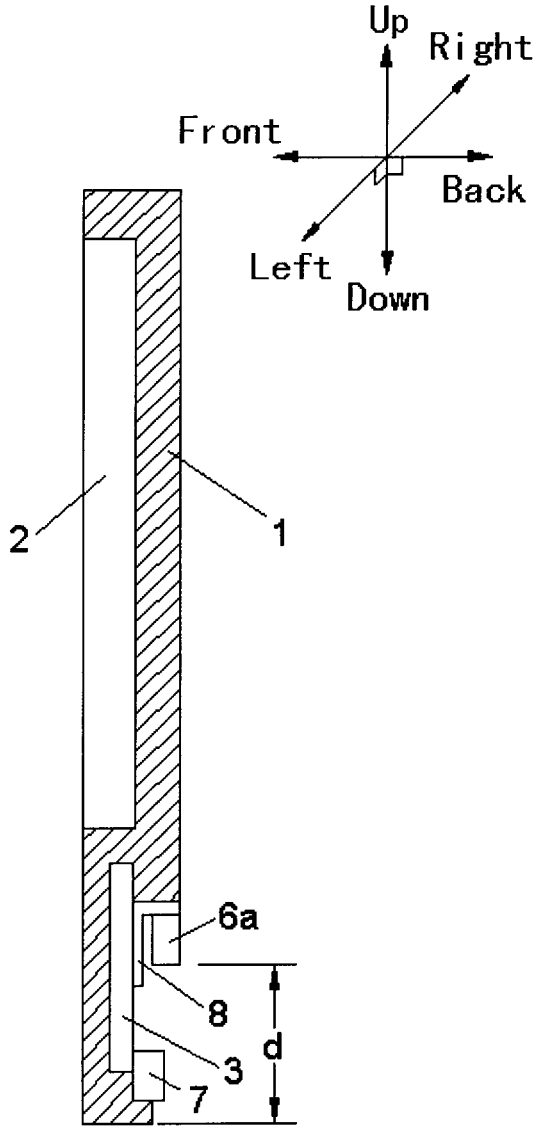
FIG. 2A is a sectional view taken along line X1-X1 in FIG. 1.
Figure 2B:
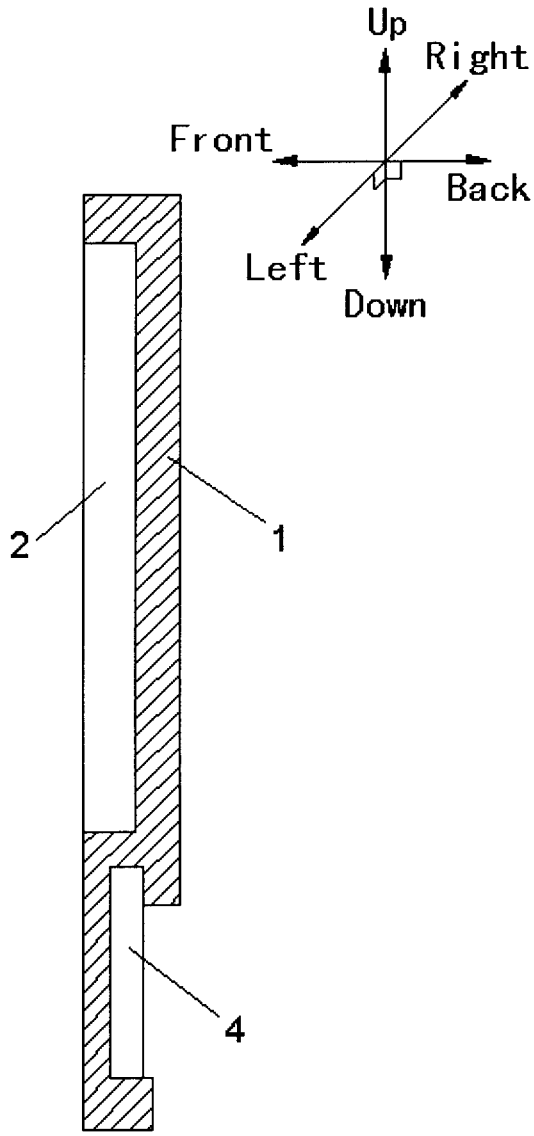
FIG. 2B is a sectional view taken along line X2-X2 in FIG. 1.
Figure 2C:
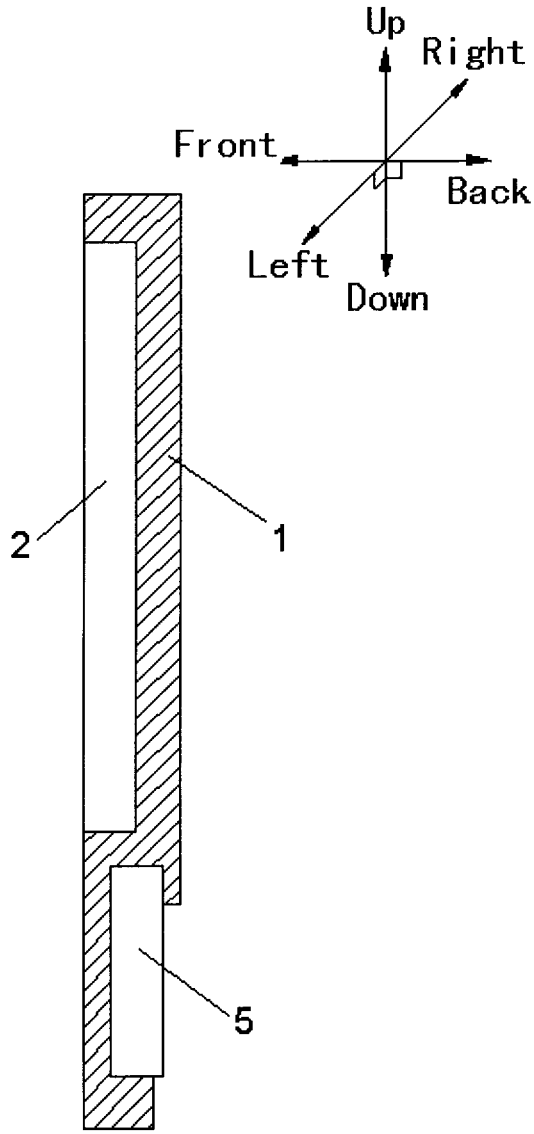
FIG. 2C is a sectional view taken along line X3-X3 in FIG. 1.
Figure 3:
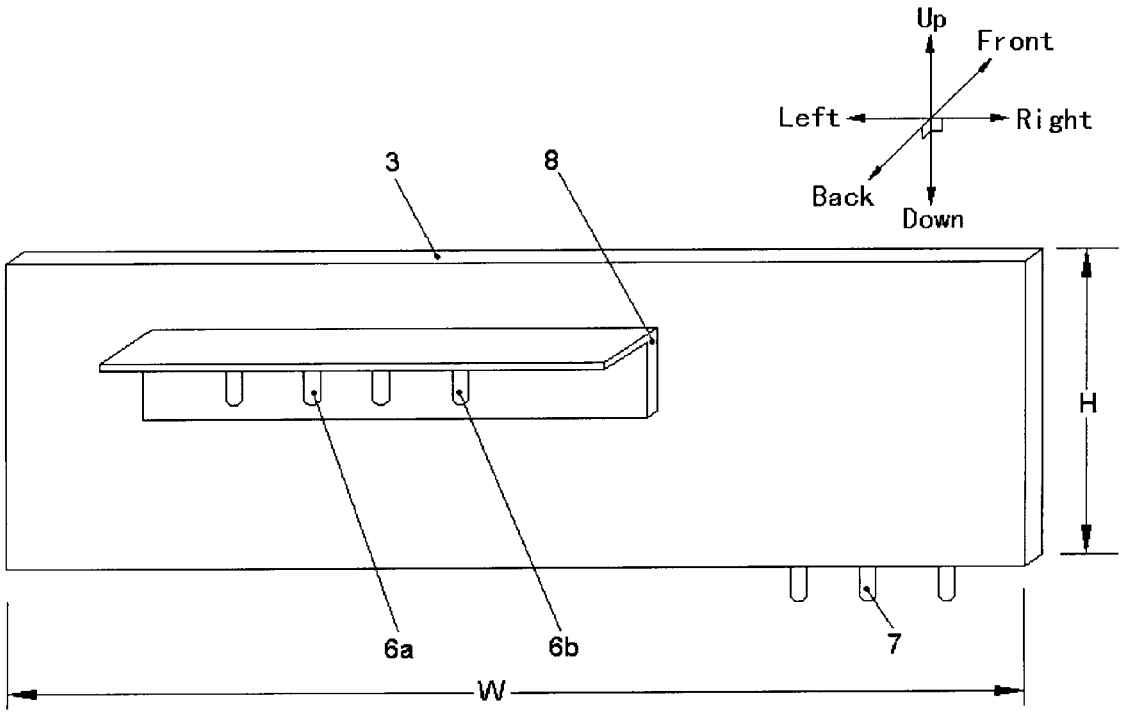
FIG. 3 is a perspective view of a portion of the control circuit in FIG. 1.

FIGS. 1 to 3 show a thin apparatus for displaying image of the first embodiment of the present invention. For purpose of convenient description, the direction extending right and left in FIG. 1 is defined as the width direction, up and down as the height direction, and forth and back as the thickness direction. As shown in FIG. 1, the thin displaying apparatus comprises: displaying panel 2 for displaying image; control circuit 3 for processing signals of image, sound and like; power supply circuit 4 for supplying power to control circuit 3, panel driving circuit (not shown) and like; a pair of speakers 5 and like. Said displaying panel 2, control circuit 3, power supply circuit 4 and a pair of speakers 5 are mounted in cabinet 1.

As shown in FIG. 1, displaying panel 2 is located in the upper portion of the displaying apparatus, and control circuit 3, power supply circuit 4 and speakers 5 are located under displaying panel 2 and arranged in a row in the width direction with same height. Compared with the technical solution that control circuit 3, power supply circuit 4, speakers 5 and like are located on the back of displaying panel 2, the technical solution that control circuit 3, power supply circuit 4, speakers 5 and like are located under the displaying panel 2 and arranged in a row in the width direction with same height advantageously reduces the size in thickness direction of the displaying apparatus.

As shown in FIG. 1, a pair of speakers 5 are arranged symmetrically at the most right (end and the most left end under displaying panel 2, control circuit 3 and power supply circuit 4 are arranged between the pair of speakers 5 with control circuit 3 located on the left side of power supply circuit 4 in FIG. 1. Of course, the number of speaker is one or more, the line order of the control circuit 3, the speaker and the supply circuit 4 is variable.

Control circuit 3, power supply circuit 4 and speakers 5 are arranged at the substantially same vertical level and aligned with each other in the right-left direction. This layout advantageously improves further the compactness of the overall structure of the displaying apparatus. Furthermore, this layout makes the displaying apparatus have more balanced weight distribution, therefore, the hanging stableness is advantageously improved when the displaying apparatus must be hanged.

As shown in FIGS. 1 and 3, the width (W) of control circuit 3 is larger than its height (H). The reason for adopting this shape of control circuit 3 is to utilizing sufficiently the space in width direction of the displaying apparatus (this space depends on the size in width direction of displaying panel 2 regardless of the size of cabinet 1) and to minimize the size in height direction of the displaying apparatus (this size depends on the sum of the sizes in height direction of displaying panel 2 and speakers 5 regardless of the size of cabinet 1). Since the sizes in width and height directions of displaying panel 2 are fixed, the only feasible way to reduce the size in height direction of the displaying apparatus is to minimize the height (H) of control circuit 3. Area (A) of control circuit 3=width (W)× height (H), therefore, in the case of fixed area (A) of control circuit 3, if width (W) is increased, height (H) will be decreased, so that the overall height of the displaying apparatus can be reduced.

Specifically, as shown in FIG. 1, regardless of the size of cabinet 1, the height of the space where control circuit 3, power supply circuit 4 and speakers 5 reside depends mainly on the height of the outline of speaker 5. The space in the width direction between speakers 5 is assigned reasonably to control circuit 3 and power supply circuit 4 according to their sizes. In order to maximize the space in the width direction between speakers 5, which will be assigned to control circuit 3 and power supply circuit 4, as shown in FIG. 1, speakers 5 are arranged right and left as far as possible, in one embodiment, they are arranged in the farthest-right side and the farthest-left side under displaying panel 2, that is, the sum of the sizes in the width direction of control circuit 3, power supply circuit 4 and speakers 5 is equal to the width of displaying panel 2.

Specifically, as shown in FIG. 2, displaying panel 2 is located in the front of the displaying apparatus. Specifically, displaying panel 2 is a LCD or a plasma display.

As shown in FIGS. 1 and 2, on the back of the displaying apparatus are arranged analog video input terminal 6*a* (referred to as the first input terminal) for inputting analog image signal, analog video output terminal 6*b* for outputting analog image signal, analog audio input terminal 6*c* for inputting analog audio signal, audio output terminal 6*d* for outputting analog audio signal, and digital interface input terminal 7 (referred to as the second input terminal). Of course, it is unnecessary for the displaying apparatus to arrange analog video output terminal 6*b*, analog audio input terminal 6*c* or analog audio output terminal 6*d* as needed.

As shown in FIG. 3, analog video input terminal 6*a*, analog video output terminal 6*b*, analog audio input terminal 6*c*, analog audio output terminal 6*d* and digital interface input terminal 7 are downward, and the axes thereof are substantially parallel to the back of displaying panel 2 (note: it is apparent for the people skilled in the art that the term of "parallel to" or "absolutely parallel to", which is applied in the present application, is just a physical concept, so that "parallel to" or "absolutely parallel to" in physical concept actually cannot be achieved in the industrial application due to inevitable errors). Of course, above terminals 6*a*, 6*b*, 6*c*, 6*d* and 7 can have the sideward (rightward or leftward), up-inclined or down-inclined orientations as long as the axes thereof are substantially parallel to the back of displaying panel 2. Since input/output terminals 6*a*, 6*b*, 6*c*, 6*d* and 7, which are arranged in the above manner, extend in the direction parallel to displaying panel 2 rather than vertical thereto (that is, backward), the size in the thickness direction of the displaying apparatus can be reduced. Further, when the displaying apparatus must be hanged on the wall, this arranging manner can prevent the video/audio input cables, video/audio output cables and the digital interface input cable from being seriously bended or damaged due to pressed by the wall.

Specifically, as shown in FIG. 2A-2C, in order to minimize the thickness of the displaying apparatus, that is, make it equal to the thickness of displaying panel 2 regardless of the size of cabinet 1. Preferably, control circuit 3, power supply circuit 4 and speakers 5 are configured so as to make the sum of the thickness of control circuit 3 and the size in the thickness direction of analog video input terminal 6*a* (or any one of analog video output terminal 6*b*, analog audio input terminal 6*c*, analog audio output terminal 6*d* and digital interface input terminal 7), the thickness of power supply circuit 4, the thickness of speakers 5 smaller than or equal to the thickness of displaying panel 2 respectively.

Specifically, as shown in FIG. 2, analog video input terminal 6*a* is located at a certain distance (d) high from the bottom of the displaying apparatus. In case of viewing from the front of the displaying apparatus, when a video input cable (not shown) is connected to analog video input terminal 6*a*, above-mentioned distance (d) is enough to make the displaying apparatus shade the bottom distal end of a plug connected with video input terminal 6*a*, which can prevent the plug from being seen from the front of the displaying apparatus. Therefore, this reasonable arranging manner increases the beautiful appearance of the whole displaying apparatus.

Specifically, as shown in FIG. 1, analog video output terminal 6*b*, analog audio input terminal 6*c* and analog audio output terminal 6*d* are arranged alongside of analog video input terminal 6*a* in the width direction.

Specifically, as shown in FIG. 2, 3, analog video input terminal 6*a*, analog video output terminal 6*b*, analog audio input terminal 6*c* and analog audio output terminal 6*d* are arranged on the board 8 and connected with control circuit 3 through the board 8. The board 8 is located behind control circuit 3 and overlapped therewith. Above-mentioned arranging manner achieves the indirect connections of the video/audio input terminals and video/audio output terminals with control circuit 3, therefore this more reasonable connecting manner not only improves the layout of the input/output terminals, but also increases the beautiful appearance of whole displaying apparatus.

Specifically, as shown in FIG. 2, 3, digital interface input terminal 7 is arranged at the edge of the control circuit 3, for example near the bottom of the displaying apparatus. This arranging manner facilitates a user to connect an outer digital input apparatus such as a computer to the displaying apparatus through digital interface input terminal 7. Preferably, digital interface input terminal 7 is arranged so as to make the displaying apparatus cover its bottom.

Specifically, digital interface input terminal 7 is a HDMI terminal or a terminal for PC, as shown in FIG. 2, 3, digital interface input terminal 7 is fixed directly on control circuit 3. The harmful influence will not exerted on control circuit 3 even if digital interface input terminal 7 is fixed directly thereon, because it has a weaker noise. The digital signal such as for HDMI and PC terminals is more high-frequency than analog signal. Therefore, in case that the line distance between the terminal and control circuit is long, it gets into a noise source. On the other hand, analog signal does not come under the influence of the long line distance in point of transmission noise.

The present invention contemplates to "minimize the 3-D sizes of the displaying apparatus", that is, regardless of the size of the cabinet, to make the thickness, height and width of the displaying apparatus equal to the thickness of the displaying panel, the sum of the heights of the displaying panel and the speakers, and the width of the displaying panel respectively.

While the preferred embodiment of the present invention is described in detail above, it is apparent for the people skilled in the art that various variations and modifications can be made within the scope of the present invention. In summary, the protection scope of this patent is subject to the claims.

The invention claimed is:

1. A thin apparatus for displaying an image, comprising:

a first input terminal configured to input an image signal, the first input terminal being located on a back side of the thin apparatus;

a panel configured to display images, the panel being located on a front side of the thin apparatus;

a control circuit configured to control the image signal; and a board disposed on the control circuit, wherein the axis of the first input terminal is substantively parallel to the back of the panel, the control circuit is located along the periphery of the panel, a width of the control circuit is longer than the height of the control circuit to reduce the size in the height direction of the thin apparatus, and the first input terminal is provided on the board, the board being connected to and overlapping the control circuit.

2. The thin apparatus as claimed in claim 1, wherein the first input terminal is located on a certain distance from the bottom of the thin apparatus; and the certain distance is set such that the bottom of the terminal connected to the first input terminal when viewing from the front of the thin apparatus is shaded.

3. The thin apparatus as claimed in claim 2, further comprising a second input terminal configured to input the image signal; and wherein the second input terminal is directly fixed on the control circuit.

4. The thin apparatus as claimed in claim 3, wherein the first input terminal is an analog input terminal, and the second input terminal is a digital input terminal.

5. The thin apparatus as claimed in claim 1, further comprising a supply circuit and a speaker; and wherein the control circuit, the supply circuit and the speaker are located along the periphery of the panel and arranged in a row with the same height to reduce the size in the height direction of the thin apparatus.

6. The thin apparatus as claimed in claim 5, wherein the total size of the control circuit, the supply circuit and the speaker along the width direction is equal to or shorter than the width of the panel to reduce the size in the height direction of the thin apparatus.

7. The thin apparatus as claimed in claim 1, wherein the control circuit is disposed below the panel when the panel is placed in an upright position.

8. The thin apparatus as claimed in claim 1, wherein the width of the control circuit is longer than the height of the control circuit to minimize the size in the height direction of the thin apparatus.

* * * * *